US007401564B1

(12) United States Patent
Ham

(10) Patent No.: US 7,401,564 B1
(45) Date of Patent: Jul. 22, 2008

(54) COLLAPSIBLE ROPE STORAGE AND CLEAT APPARATUS

(76) Inventor: Brian Scott Ham, 4189 143rd Ave. SE., Alice, ND (US) 58031

( * ) Notice: Subject to any disclaimer, the term of this patent is extended or adjusted under 35 U.S.C. 154(b) by 0 days.

(21) Appl. No.: 11/215,293

(22) Filed: Aug. 30, 2005

(51) Int. Cl.
*B63B 21/04* (2006.01)

(52) U.S. Cl. ..... 114/218

(58) Field of Classification Search ..... 114/218, 114/361, 364

See application file for complete search history.

(56) References Cited

U.S. PATENT DOCUMENTS

| | | | | | |
|---|---|---|---|---|---|
| 36,696 | A | * | 10/1862 | Andrews | 114/218 |
| 391,526 | A | * | 10/1888 | Foran | 114/218 |
| 1,010,108 | A | * | 11/1911 | Ashworth | 114/218 |
| 1,670,715 | A | | 5/1928 | Doherty | |
| 2,555,805 | A | * | 6/1951 | Miller | 114/218 |
| 2,690,152 | A | | 9/1954 | Riccio | 114/190 |
| 2,833,075 | A | | 5/1958 | Herron | 43/25.2 |
| 3,612,426 | A | | 10/1971 | Germock, Jr. | 242/85 |
| 3,838,830 | A | | 10/1974 | Pettit | 242/96 |
| 4,277,035 | A | | 7/1981 | Gaski | 242/85.9 |
| 4,586,675 | A | | 5/1986 | Brown | 242/85.1 |
| 4,779,817 | A | | 10/1988 | Bjork | 242/96 |
| 5,012,559 | A | | 5/1991 | Flannery | 24/71.3 |
| 5,145,122 | A | | 9/1992 | Poister | 242/85.1 |
| 5,348,240 | A | | 9/1994 | Carmo et al. | 242/401 |
| 5,829,377 | A | * | 11/1998 | Hoppenhaus | 114/218 |
| 6,237,885 | B1 | | 5/2001 | Mitchell | 248/205.4 |
| 6,302,347 | B1 | | 10/2001 | Amirault | 242/405.2 |
| 6,676,061 | B1 | | 1/2004 | Cain | 242/401 |

* cited by examiner

*Primary Examiner*—Lars A. Olson

(57) ABSTRACT

This collapsible rope storage and cleat apparatus having a folding cleat shaft for easy removal of stored cordage provides a method of storing or tying off a rope to mount surface in a manner that is both simple in its construction and operation and which eliminates the problems associated with the use of standard tie off cleats.

20 Claims, 7 Drawing Sheets

FIG 2
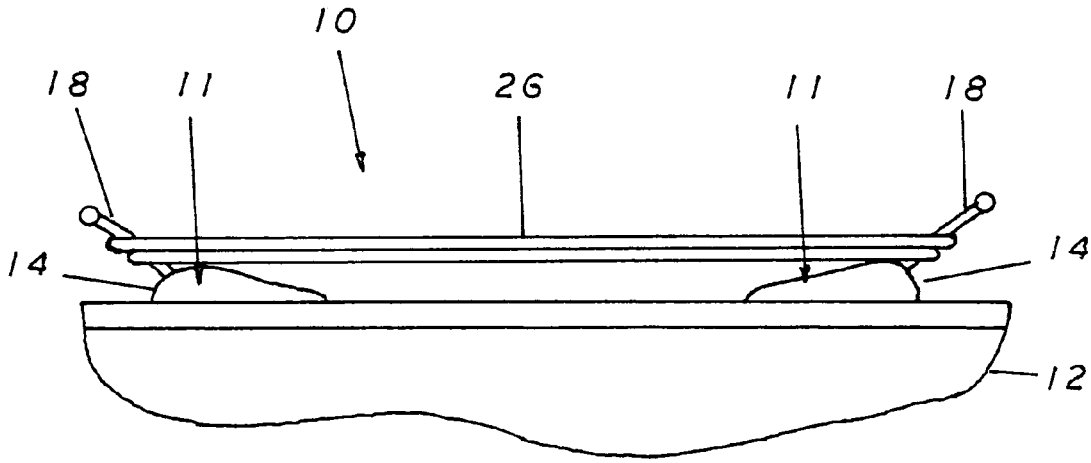
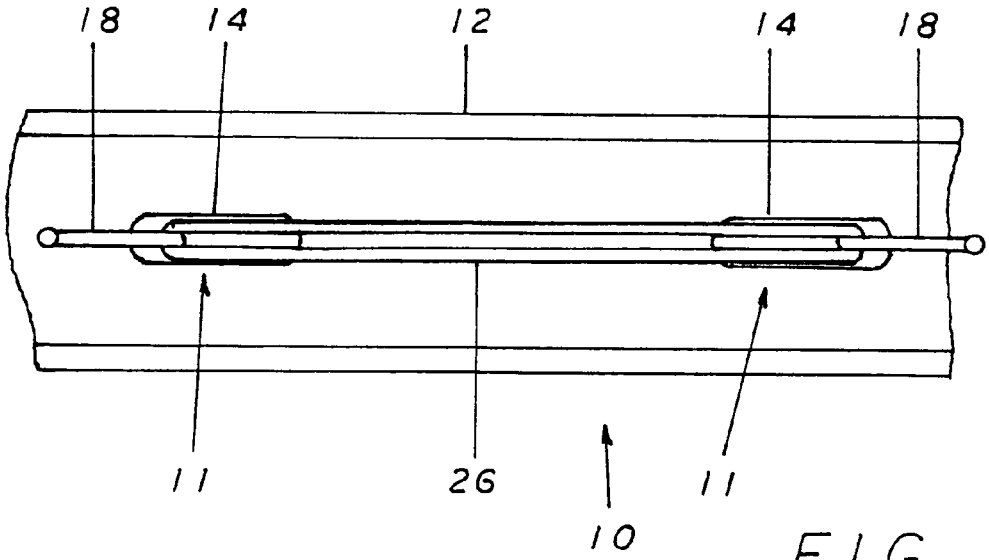
FIG 3

FIG 4
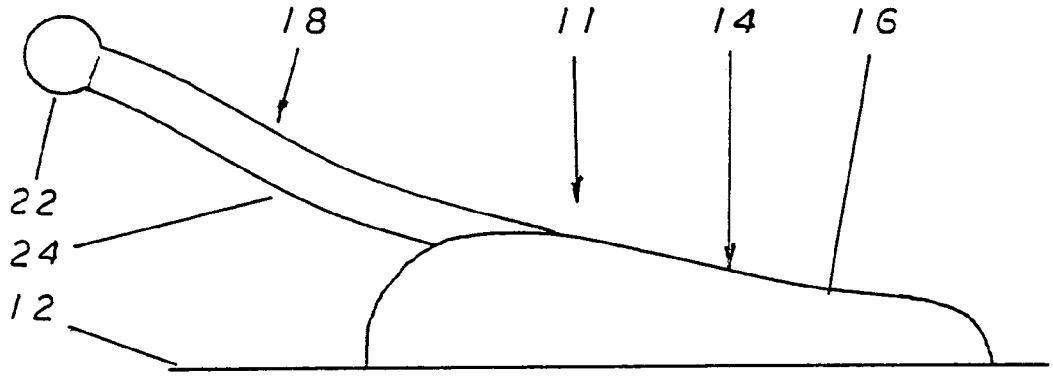
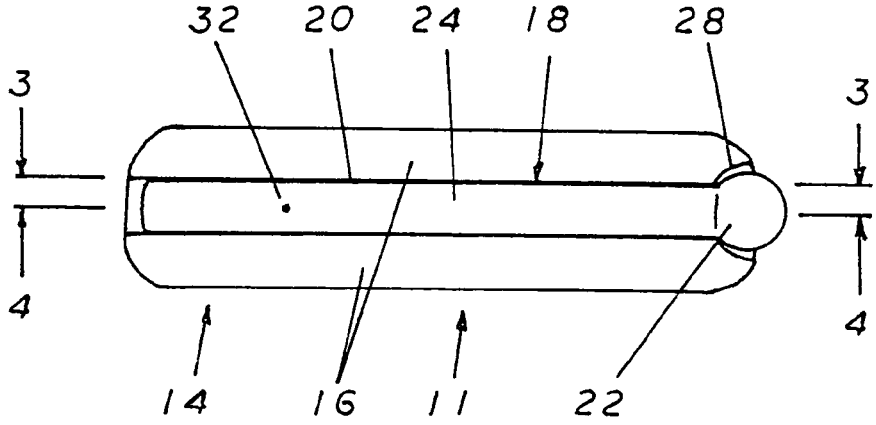
FIG 5

FIG 6
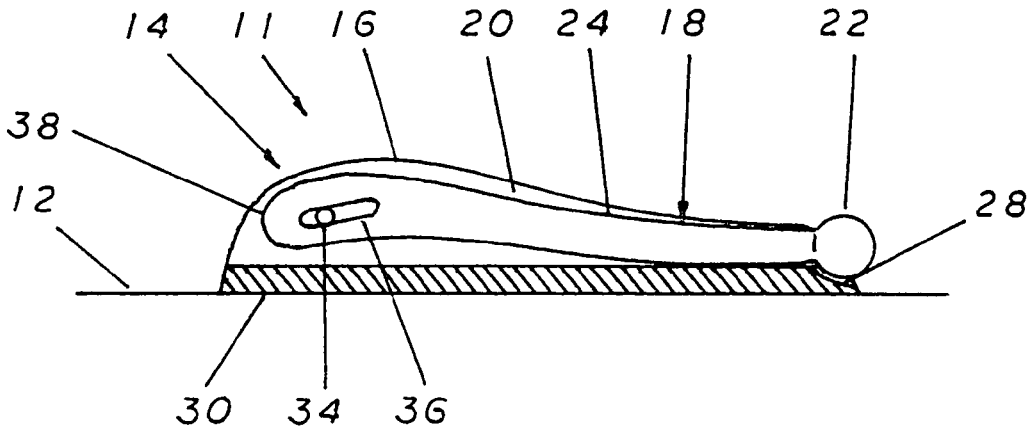
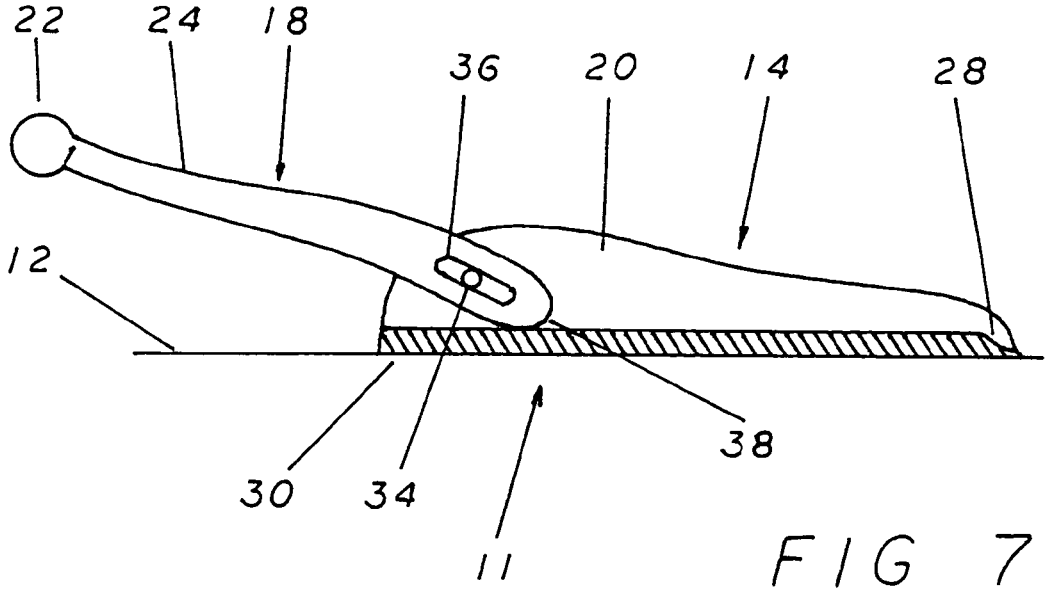
FIG 7

FIG 8
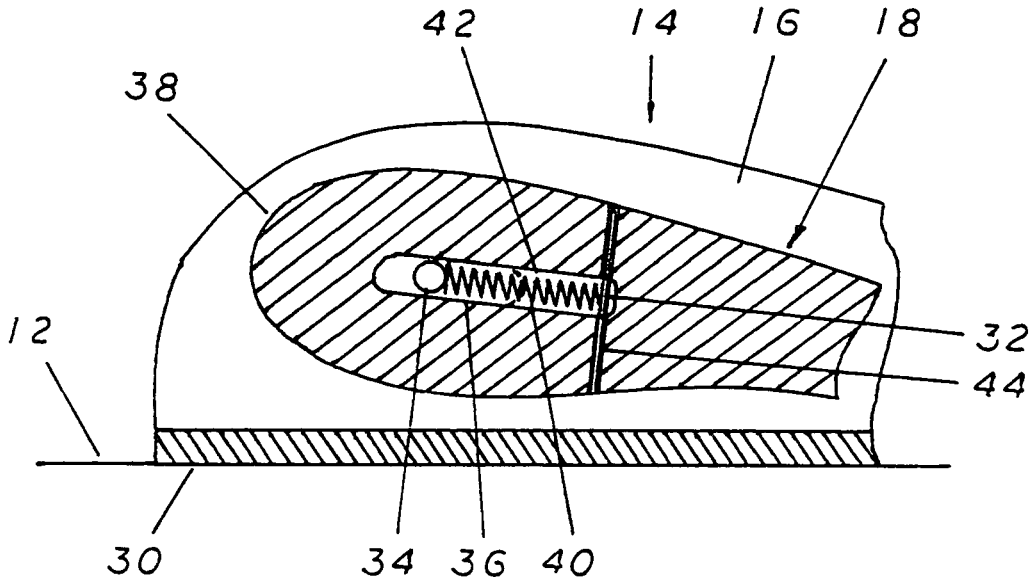
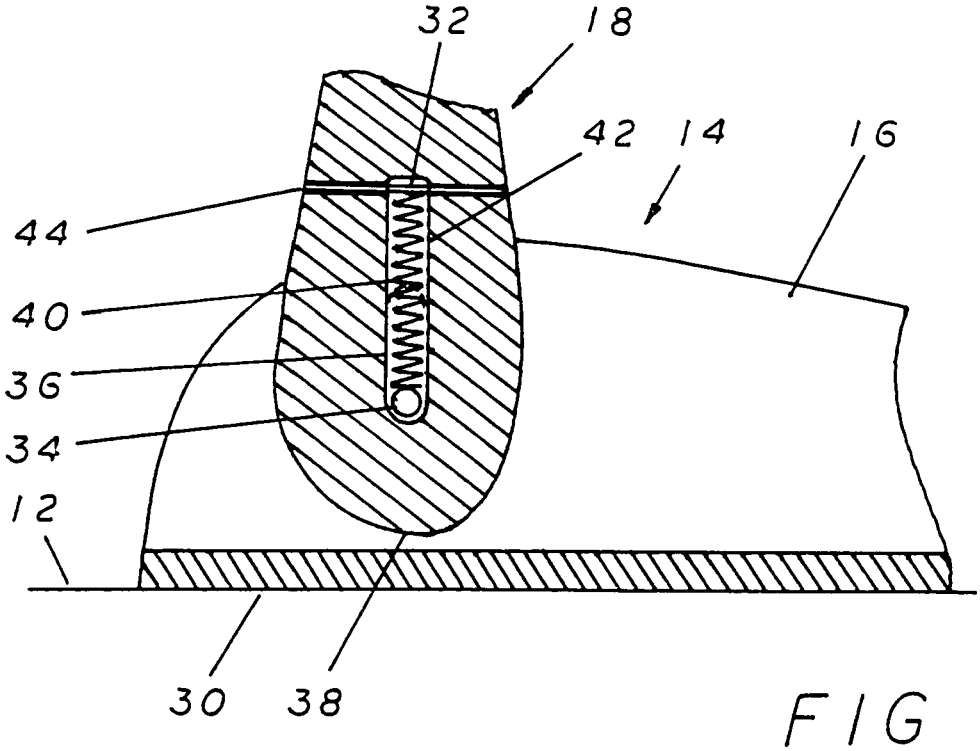
FIG 9

FIG 10
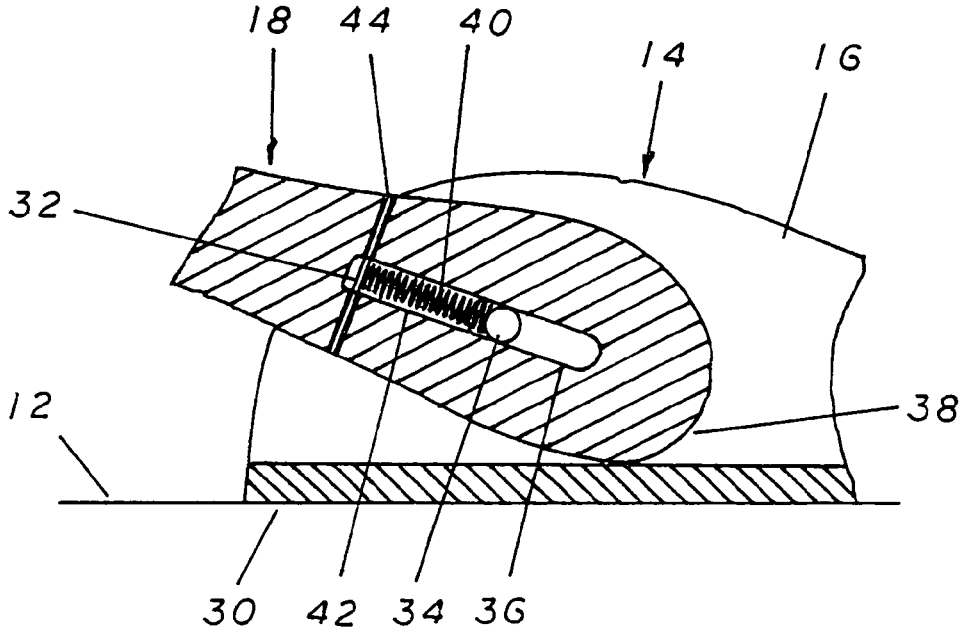
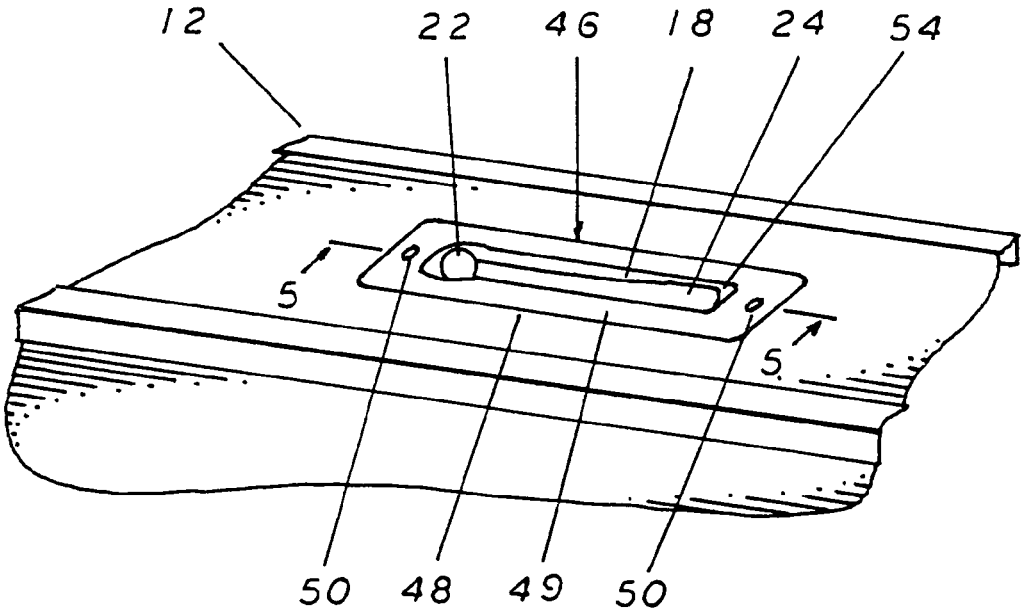
FIG 11

COLLAPSIBLE ROPE STORAGE AND CLEAT APPARATUS

BACKGROUND OF THE INVENTION

The present invention relates to an improvement in the devices employed to store or tie off ropes in work shops, boats, and other similar applications. More specifically, to a cleat or rope storage device which has the capability of being collapsed when not in use or expanded when needed thereby providing a secure point at which to store or tie off rope that does not suffer from the limitations common in the cleats or other similar apparatuses in use today.

The use of cleats for gathering, storing, or tying off ropes is common in many applications. Cleats offer a way to secure a rope in a designated location and manner that allows for their storage and quick and easy removal. It is these characteristics that makes the use of cleats so prevalent in many applications including the boating industry for such purposes as the storing of unused rope, securing ropes, or other similar purposes. However, this discussion should not be interpreted as limiting its scope to the specific content as the characteristics described herein apply equally as well in all possible applications that employ the use of rope storage or tie off cleats.

While storage or tie off cleats work well in their intended purpose, they do suffer from short comings. The most obvious of these stems from the fact that, due to their intended purpose, they are necessarily objects that extend into an area where they may come into contact with unintended objects. Additionally, the nature of their intended use also requires that they be constructed of a strong and durable material such as a metal and are thus capable of causing damage to property and even injury. This circumstance is also exacerbated due to the fact that cleats are also often constructed with relatively sharp edges or protruding elements. Finally, the devices in common use today do not provide an adequate amount of space to allow for the storage of long length of rope.

As a result of these circumstances, there have been many efforts to provide a storage or tie off cleat apparatus that overcomes these problems. The most common of these consist of cleat apparatuses which are designed in a manner that allows them to be retracted below the surface on which they are being employed. These cleat apparatuses generally consist of a base which is fixedly attached to the desired surface, a well which extends below the surface, and a cleat member that is capable of being extended above the surface for use or retracted into the well when not in use. The cleat member is generally spring loaded in such a manner so that pressure placed on its upper surface will either force it into and lock it within the well or release it and allow the spring tension to force it up above the employed surface. These systems offer a means of providing a mechanism for storing or tying off a rope while avoiding the problems that unused cleats pose.

While the retractable cleats described provide a solution for the problems described above, they also suffer deficiencies that affect their overall performance. The first of these is that their manner of construction is relatively complex and therefore subject to failure. Not only does this complexity create the potential for problems in and of itself, but it also creates opportunities for apparatus failure due to debris interfering with the function of their more sensitive components. Additionally, the complex nature of their construction also drives the cost of these tie off cleats to a level that makes the implementation difficult for some of the public. This is an especially significant problem in boating applications requiring the use of a large number of cleats. Finally, these devices also are typically of such a small storage capacity that they do not provide a means of storing longer than average lengths of rope.

Therefore, from the foregoing discussion it can be seen that it would be desirable to provide a tie off cleat apparatus which is capable of being collapsed when not in use and expanded when needed. Additionally, it can be seen that it would be desirable to provide such a storage or tie off cleat apparatus that does not suffer from the complexity and cost problems which are common to those offered by the prior art.

SUMMARY OF THE INVENTION

It is the primary objective of the present invention to provide a rope storage or tie off cleat apparatus which is capable of being collapsed or expanded as needed.

It is an additional objective of the present invention to provide such a rope storage or tie off cleat apparatus that is simple both in its manner of construction and operation thereby avoiding the problems of complexity and high cost.

It is a further objective of the present invention to provide such a rope storage or tie off cleat apparatus that does not pose a threat to property or health whether it is expanded for use or collapsed for storage.

It is a still further objective of the present invention to provide such a rope storage or tie off cleat apparatus that is capable of storing a long length of rope in a manner that will allow for its easy removal when needed.

These objectives are accomplished by the use of a collapsible rope storage and cleat apparatus having a cleat body and pivotal cleat members. The cleat body is a generally rectangularly shaped component having two cleat body sides that have curved upper surfaces in their longitudinal profiles. Additionally, the two parallel body sides are separated by a cleat well. The cleat well is a depression in the cleat body which runs longitudinally down its center. The cleat well provides the point of attachment for the pivotal cleat members and also serves to protect it when it has been stored in the cleat well when the collapsible cleat apparatus is not being used.

The present invention is made up of a pair or more of the rope storage and cleat apparatuses as described above which are employed to facilitate the storage or securing of a rope to a desired surface. To accomplish this, the cleat bodies are fixedly attached to the desired surface by any number of methods the most common of which is the use of a plurality of screws that pass through the cleat body and into the surface. This provides a solid base for the operation of the present invention allowing the cleat members to be rotated up and out of the cleat body's cleat well and locked into place in the proper position. Once the cleat members of a pair or more of the cleat apparatuses have been thus prepared, the user may then store or secure a rope to them by passing it around the alternating cleat members in a desired pattern, generally a straight loop, to store or secure the rope in the desired location. The use of the loop pattern allows for the quicker removal of the rope from the cleat apparatus as it allows one of the cleat members to be lowered while the rope is engaged and for the easy removal of the rope in a circular loop configuration. Other rope looping patterns may also be employed but the above described method is preferred with the present invention.

The pivotal attachment of the cleat member to the cleat body is critical to the operation of the present invention. As previously stated, the cleat member is mounted within the cleat well in a pivotal manner. This mounting is accomplished by the use of a pivot pin which laterally spans the cleat well between the inner surfaces of the two cleat body sides in a location where it may properly engage the proximal end of the cleat member. To facilitate the pivotal connection of the cleat member, its proximal end is equipped with a pin mount hole. The pin mount hole passes through the proximal end of the cleat member from side to side and is elongated in the horizontal plane with reference to the cleat member. The elongated nature of the pin mount hole allows the position to alter relative to the pivot pin which is critical to the operation of the present invention and will be further discussed below.

The proximal end of the cleat member is also constructed in a manner that facilitates its pivotal operations. This construction is such that, as viewed from the side, the proximal end of the cleat member has a curved form resembling a slightly more than 180 degree circle and when viewed either from the top or bottom is flat. This flat surface forms the engagement surface of the cleat member which engages the base of the cleat body when the cleat member is extended for use. The cleat member also has a cleat shaft which extends outward from the point of pivotal attachment and terminates at the cleat head at its distal end. The cleat head is a spherically shaped component which functions to help retain a tie off rope when the cleat member is deployed for use.

The elongated construction of the pin mount hole is critical to the operation of the present invention as it allows the cleat member's position relative to the mount pin to be altered during its operation. The altering of the position of the cleat member also varies its position relative to the cleat body which in turn facilitates its abilities to be stored within the cleat well, to rotate around the pivot pin, and to lock into the extended position for use with a rope.

Operating in conjunction with the mount hole, the proximal end of the cleat member also has a spring mounted within an internally positioned spring cavity. The spring is biased towards contraction thereby tending to pull the distal end of the spring cavity towards the pivot pin. The spring cavity is essentially an extension of the pin mount hole extending forward within the cleat member from its distal end. The spring in turn is connected on its proximal end to the pivot pin and on its distal end to a spring pin which passes through a spring pin hole positioned within the cleat member so that the spring pin passes through the distal end of the spring cavity. This manner of placement of the spring allows it to operate on the cleat member to ensure that it is capable of being rotated between the extended and collapsed positions.

In the collapsed position, the spring holds the cleat member in a position so that the pivot pin is maintained slightly towards the proximal end from the center of the pin mount hole. To begin the rotation of the cleat member from its collapsed position, the user simply grasps the cleat head at its distal end and places an upward force thereon. This serves to rotate the cleat member around its pivotal attachment to the pivot pin. When the cleat member nears a vertical orientation relative to the cleat body, its engagement surface comes into contact with the cleat base thereby ending its rotational ability. This situation is overcome by placing an outward force on the cleat head which further expands the spring and moves the cleat member so that the pivot pin slides to the extreme proximal end of the pin mount hole. This action in turn increases the distance between the cleat member's engagement surface and the cleat base allowing for the further rotation of the cleat member into the fully expanded position.

Once the cleat member has been so positioned, the outward pressure on its distal end may be released which in turn allows the spring to compress and reposition the pivot pin towards the center of the pin mount hole. This in turn brings the cleat member's engagement surface back into contact with the cleat base which effectively locks it into the extended position for its intended use. Conversely, the collapsing of the extended cleat member is accomplished simply by reversing the steps described above.

An alternative embodiment of the present invention is also contemplated in which flush mount base is employed. The flush mount base is also a generally rectangular shaped apparatus having an outer mount lip surrounding a recessed cleat well. These two components operate together to allow the cleat member to be stored below the employed surface when it is in storage. Additionally, the recessed cleat well is also equipped with a drain hole that is attached to a drain tube. The purpose of the drain hole is to provide a means by which water collecting within the recessed cleat well can be removed thereby eliminating a source of potential damage to the operation components of the present invention. Additionally, the drain hole and tube also provide a means by which any unwanted water may be collected and removed thereby preventing damage to the equipment with which the present invention is being used. In all other aspects of construction and operation, this alternative embodiment of the present invention operates in the same manner as described above for the initial embodiment.

For a better understanding of the present invention reference should be made to the drawings and the description in which there are illustrated and described preferred embodiments of the present invention.

DESCRIPTION OF THE DRAWINGS

FIG. 2 is a side elevation view of the present invention of FIG. 1 illustrating the manner in which it is employed to store or secure a rope.

FIG. 3 is a top elevation view of the present invention of FIG. 1 illustrating the manner in which it is employed to store or secure a rope.

FIG. 4 is a side elevation view of the cleat component of the present invention illustrating the orientation of its major components in the extended position.

FIG. 5 is a is a top elevation view of the cleat of FIG. 4 illustrating the orientation of its major components in the collapsed position.

FIG. 6 is a side elevation cross sectional view of the present invention of FIG. 5 taken along line 3 and illustrating the orientation of the cleat member within the cleat well and the manner of construction of the pin mount hole.

FIG. 7 is a side elevation cross sectional view of the present invention of FIG. 5 taken along line 3 and illustrating the position of the cleat member in the extended position and the operations of the engagement surface and pin mount hole.

FIG. 8 is a side elevation cross sectional view of the present invention of FIG. 5 taken along line 4 and illustrating the manner of construction and operation of the spring and related components.

FIG. 9 is a side elevation cross sectional view of the present invention of FIG. 5 taken along line 4 and illustrating the operation of the spring and pivot pin during the rotation of the cleat member.

FIG. 10 is a side elevation cross sectional view of the present invention of FIG. 5 taken along line 4 and illustrating the relative positions of the engagement surface and cleat base when the cleat member is locked in the extended position.

FIG. 11 is a perspective view of an alternative embodiment of the present invention which employs flush mount cleat base to secure the collapsible cleats to the mount surface.

DESCRIPTION OF THE PREFERRED EMBODIMENT

Figure 1:
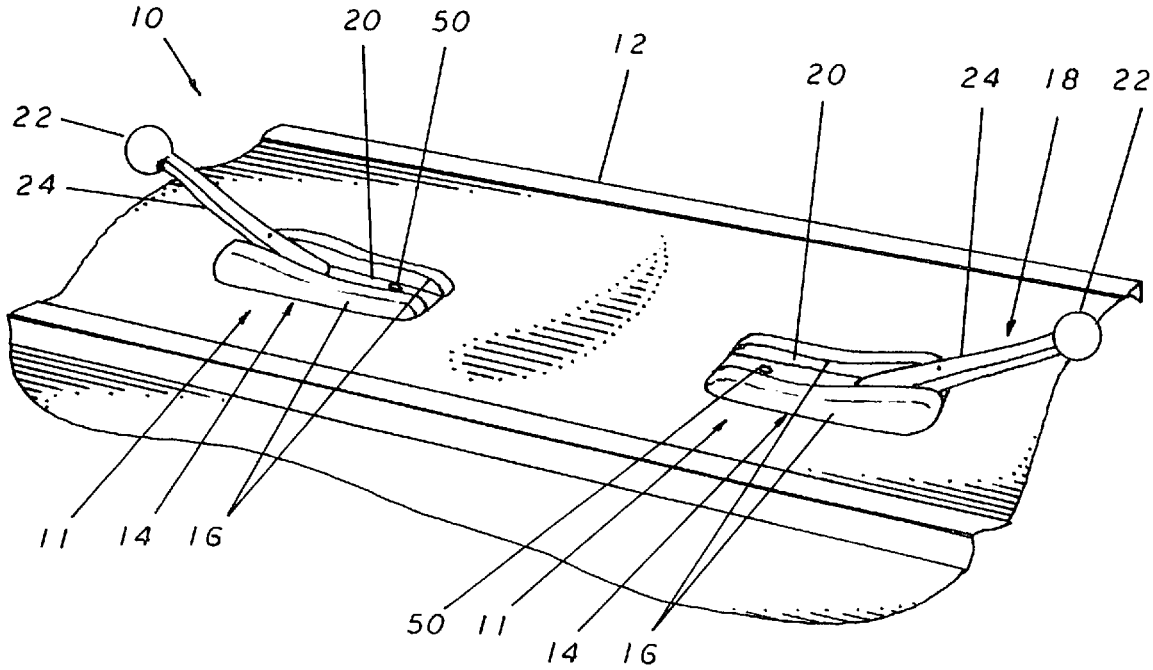
FIG. 1 is a perspective view of the present invention which illustrates the manner in which it is employed in conjunction with a mount surface for the purpose of providing a place of storage or securement for a rope.

Referring now to the drawings, and more specifically to FIGS. 1, 2, 3, 4, and 5, the collapsible rope storage and cleat apparatus 10 is a rope 26 tie off device that is fixedly attached to a mount surface 12 and employed to store or tie off ropes 26. The present invention is most commonly composed of two cleats 11 (although other configurations are possible) which are attached to the mount surface 12 in opposing orientations and at a desired distance to facilitate the tying off of a rope 26. The fixed attachment of the cleats 11 to the mount surface 12 is most commonly accomplished by the use of a plurality of mount screws 50 which pass though the cleat body 14 and into the mount surface 12.

The cleats 11 of the present invention are made up of two primary components. The first of these is the cleat body 14 which is a generally rectangularly shaped device when viewed from the top and an irregularly curved upper surface when viewed from the side. The cleat base 14 is made up of two cleat sides 16 defining the outer edges of the long side of the rectangle which are separated by a centrally located cleat well 20. The cleat well 20 in turn provides for the point of pivotal attachment for the cleat member 18. The cleat member 18 is then the component of the present invention which is used to provide the point of securement for the rope 26.

The cleat member 18 is made up of a cleat shaft 24 which is an elongated device that is pivotally attached to the cleat body 14 at its proximal end and having a spherical cleat head 22 at its distal end. The cleat head 22 fits within a head receptacle 28 which is a lateral expansion of the cleat well 20 which corresponds in location to the cleat head 22 when the cleat member 18 is in the collapsed position. The cleat head 22 serves two functions. The first of these is to provide a grasping for the user to facilitate the pivoting function of the cleat member 18. The second is to form a restraining barrier to ensure that the rope 26 cannot slip off the end of the cleat member 18 during operations. Additionally, the cleat shaft 24 of the cleat member 18 is constructed in a manner so that, when viewed from the side, has a slight S-shape which also aids in the retention of the rope 26 on the cleat members 18.

With a pair of the cleats 11 properly positioned and secured to the mount surface 12 as described above, a rope 26 may be secured to them in any number of ways. The most common method employed is to place a looped end of the rope 26 over one of the extended cleat members 18 and proceed to wrap it around the extended cleat members 18 in a straight loop manner. This not only forms a secure attachment, but also allows the rope 26 to be stored and quickly removed when necessary. The removal of the rope 26 is generally accomplished by collapsing one of the cleat members 18 thereby loosening the rope's 26 engagement to the other. With this accomplished, the rope 26 can then be easily lifted from the remaining cleat member 18 to complete the removal process.

The internal construction of the cleat well 20 and the manner of the pivotal attachment of the cleat member 18 within it are further illustrated in FIGS. 6 and 7. As illustrated, the cleat well 20 terminates at its lower end at the cleat base 30 which is also the component of the present invention which facilitates the attachment of the cleats 11 to the mount surface 12. As illustrated, the pivotal attachment of the cleat member 18 is accomplished by the operation of the pivot pin 34 and the pin mount hole 36.

The pivot pin 34 is a small cylindrical rod that spans the cleat well 20 in a horizontal manner and in a position so that it may engage the central portion of the proximal end of the cleat member. This engagement is accomplished by the pivot pin 34 passing through the cleat member via the pin mount hole 36. The pin mount hole 36 is specifically designed to receive the pivot pin 34 and as such, it has a width slightly larger than the outside diameter of the pivot pin 34 and is elongated in its length. This method of design serves to hold the pivot pin 34 securely in the vertical plane with reference to the longitudinal axis of the cleat member 18 while allowing it to slide along a determined distance along the horizontal plane. The slidable nature of the attachment is critical to the expandable and collapsible nature of the cleat member 18 which will be more fully described in the text below.

These two FIGURES also illustrate the differences between the orientation of the cleat member 18 when it is in the collapsed position and when it is extended. In the collapsed position, the cleat head 22 at the distal end of the cleat member 18 rest in the head receptacle 28 and the engagement surface 38 at the proximal end remains well off of the cleat base 30 due to the nature of the connection formed by the pivot pin 34 and pin mount hole 36. Conversely, when the cleat member 18 is in the extended position, the operation of the pivotal connection at the pivot pin 34 and the pin mount hole 36 allows the engagement surface 38 to come into contact with the cleat base 30 which in turn serves to lock the cleat member 18 in the extended position required for its designed purpose.

The manner of operation of the pivot pin 34 and the pin mount hole 36 in the expanding and collapsing of the cleat member 18 are further illustrated in FIGS. 8, 9, and 10. An additional component involved in these operations is the spring 40 which is contained within the proximal end of the cleat member 18 in the spring cavity 42. The spring cavity 42 is essentially an internal hole that extends from the distal end of the pin mount hole 36 along the central longitudinal axis of the cleat member 18 terminating at a distance that would provide for the proper positioning of the spring 40. The spring 40 is then positioned within the spring cavity with its proximal end fixedly attached to the pivot pin 34 and its distal end held in place at the distal end of the spring cavity by the spring pin 32. The spring pin 32 is so positioned by the use of the spring pin hole 44 which passes through the cleat member 18 in a location so that it intersects the distal end of the spring cavity 42. Thus, with the spring 40 properly positioned within the spring cavity 42, the spring pin 32 is forced through the spring pin hole 44 and engages the distal end of the spring 40 thereby holding it securely at the location.

The use of the spring 40 in this manner facilitates both the pivoting function of the cleat member 18 in the collapsing and extending operations, but also the locking of the cleat member 18 in the extended position. In the collapsed position, the pivot pin 34 is positioned slightly towards the proximal end of the pin mount hole 36. In a neutral orientation, the spring 40 is biased towards compression serving to place a force on the cleat member 18 that would tend to retain the pivot pin 34 within the central portion of the pin mount hole 36. Therefore, the spring 40 operates to maintain the position of the cleat member 18 relative to the pivot pin 34 in the position required to facilitate its pivoting function.

The rotation of the cleat member 18 from the collapsed to the extended position is accomplished in the following manner. Initially, the user grasps the cleat head 22 on the distal end of the cleat member 18 and places a rotational force thereon. This causes the cleat member 18 to pivot around the pivot pin 34. At roughly the midpoint of the rotation of the cleat member 18, its engagement surface 38 comes into contact with the cleat base 30 thereby limiting any further rotational travel. This situation is overcome by placing outward pressure on the cleat head 22 which in turn expands the spring 40 thereby altering the position of the pivot pin 34 so that it is now located in the extreme proximal end of the pin mount hole 36. This action increases the distance between the engagement surface 38 of the cleat member 18 and the cleat base 30 which in turn allows the rotation of the cleat member 18 to continue.

When the cleat member 18 has been rotated to the point that the clearance between the engagement surface 38 and cleat base 30 is no longer an issue, the spring 40 may be allowed to return to its neutral position returning the pivot pin 34 to the central portion of the pin mount hole 36. This action serves to allow the engagement surface 38 to come into contact with the cleat base 30 which in turn locks the cleat member 18 in the extended position. This situation is a result of the fact that with the pivot pin 34 so located within the pin mount hole 36, the cleat member 18 is incapable of being rotated back toward the collapsed position thereby preparing the present invention for use as a rope 26 tie off apparatus. Conversely, to return the cleat member 18 to the collapsed position, the steps described above are simply reversed.

Figure 12:
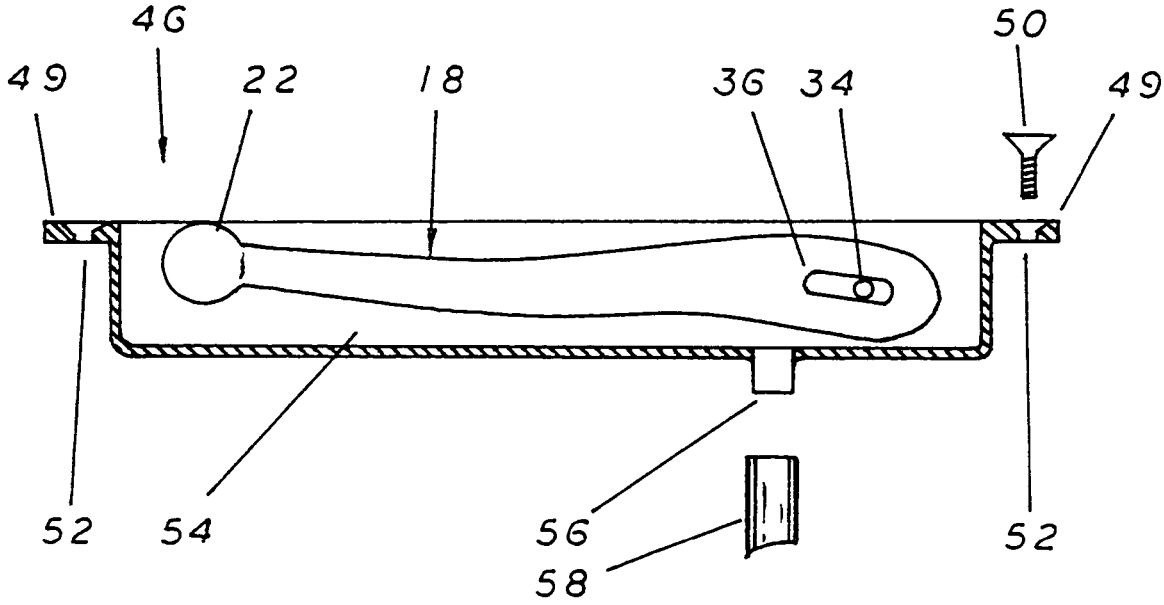
FIG. 12 is a side elevation cross sectional view of the alternative embodiment of FIG. 11 taken alone line 5 and illustrating the position of the cleat member within the recessed cleat well and the configuration of the well drain.

An alternative embodiment of the present invention is illustrated in FIGS. 11 and 12 which is the flush mount collapsible cleat apparatus 46. The primary difference in this embodiment of the present invention from the previous is that it employs a flush mount base 48 to both secure it to the mount surface 12 and to contain its remaining components. The flush mount base 48 is a generally rectangular device having an outer mount lip 49 surrounding a centrally positioned recessed cleat well 54. The mount lip 49 contains a plurality of screw holes 52 which allow for the use of mount screws 50 to fixedly attach the flush mount base 48 to the mount surface 12.

The recessed cleat well 54 as the place of pivotal attachment for the cleat member 18 and as such, operates in the same manner as described above for the previous embodiment of the present invention. The one exception to this is that the cleat member 18 when in the collapsed position is maintained below the surface of the mount surface 12. This positioning of the cleat member 18 ensures that nothing will come into contact with it when it is not being used thereby enhancing the safety features of the present invention. Finally, the lower surface of the recessed cleat well 54 is equipped with a drain hole 56 which is in turn connected to a drain tube 58. This configuration provides a means by which any water collecting within the recessed cleat well 54 can be drained off before it can interfere with the operation of this embodiment of the present invention's articulating components.

Although the present invention has been described in considerable detail with reference to certain preferred versions thereof, other versions are possible. Therefore, the spirit and scope of the appended claims should not be limited to the description of the preferred versions contained herein.

What is claimed is:

1. A collapsible cleat apparatus for holding elongate cordage said collapsible cleat apparatus comprising:

a cleat body for mounting said cleat apparatus to a mount surface said cleat body having a left and right cleat side defining a cleat well, said left and right cleat sides being substantially perpendicular to said mount surface;

a pivot pin fixedly attached between said left and right cleat sides so as to span said cleat well;

an elongate cleat member having a cleat shaft with a proximal and distal end;

said elongate cleat member defining a pivot mount slot at said proximal end such that said slot runs substantially parallel to said cleat member;

a spring cavity in the center of said cleat members proximal end said spring cavity running substantially perpendicular to said pivot mount slot; and said pivot pin pivotally attaching said elongate cleat member to said cleat body wherein said pivot pin runs from said left cleat side through said pivot mount slot and to said right cleat side such that said elongate cleat member is pivotally mounted in said cleat well.

2. A collapsible cleat apparatus as in claim 1 further comprising a cleat head at said distal end of said elongate cleat member.

3. A collapsible cleat apparatus as in claim 2 wherein said cleat head is substantially spherical.

4. A collapsible cleat apparatus as in claim 3 further comprising a spring pin spanning said spring cavity.

5. A collapsible cleat apparatus as in claim 4 further comprising a spring having a first end attached to said pivot pin and second end attached to said spring pin such that said spring is housed within said spring cavity and is biased toward a compressed position.

6. A collapsible cleat apparatus as in claim 5 wherein said cleat body extends upward from said mount surface.

7. A collapsible cleat apparatus as in claim 5 wherein said cleat body is flush mounted to said mount surface and extends downward from said mount surface.

8. A collapsible cleat apparatus as in claim 7 further comprising a drain in said cleat well.

9. A collapsible cleat apparatus for holding elongate cordage said collapsible cleat apparatus comprising:

a cleat body for mounting said cleat apparatus to a mount surface said cleat body having a left and right cleat side defining a cleat well, said left and right cleat sides being substantially perpendicular to said mount surface;

a pivot pin fixedly attached between said left and right cleat sides so as to span said cleat well;

an elongate cleat member having a cleat shaft with a proximal and distal end said cleat member further having a cleat head at its distal end;

said elongate cleat member defining a pivot mount slot at said proximal end such that said slot runs substantially parallel to said cleat member;

a spring cavity in the center of said cleat members proximal end said spring cavity running substantially perpendicular to said pivot mount slot; and said pivot pin pivotally attaching said elongate cleat member to said cleat body wherein said pivot pin runs from said left cleat side through said pivot mount slot and to said right cleat side such that said elongate cleat member is pivotally mounted in said cleat well.

10. A collapsible cleat apparatus as in claim 9 wherein said cleat head is substantially spherical.

11. A collapsible cleat apparatus as in claim 10 further comprising a spring pin spanning said spring cavity.

12. A collapsible cleat apparatus as in claim 11 further comprising a spring having a first end attached to said pivot pin and second end attached to said spring pin such that said spring is housed within said spring cavity and is biased toward a compressed position.

13. A collapsible cleat apparatus as in claim 12 wherein said cleat body extends upward from said mount surface.

14. A collapsible cleat apparatus as in claim 12 wherein said cleat body is flush mounted to said mount surface and extends downward from said mount surface.

15. A collapsible cleat apparatus as in claim 14 further comprising a drain in said cleat well.

16. A collapsible cleat apparatus for holding elongate cordage said collapsible cleat apparatus comprising:

a cleat body for mounting said cleat apparatus to a mount surface said cleat body having a left and right cleat side defining a cleat well, said left and right cleat sides being substantially perpendicular to said mount surface;

a pivot pin fixedly attached between said left and right cleat sides so as to span said cleat well;

an elongate cleat member having a cleat shaft with a proximal and distal end said cleat member further having a spherical cleat head at its distal end;

said elongate cleat member defining a pivot mount slot at said proximal end such that said slot runs substantially parallel to said cleat member;

a spring cavity in the center of said cleat members proximal end said spring cavity running substantially perpendicular to said pivot mount slot;

a spring pin spanning said spring cavity; and said pivot pin pivotally attaching said elongate cleat member to said cleat body wherein said pivot pin runs from said left cleat side through said pivot mount slot and to said right cleat side such that said elongate cleat member is pivotally mounted in said cleat well.

17. A collapsible cleat apparatus as in claim 16 further comprising a spring having a first end attached to said pivot pin and second end attached to said spring pin such that said spring is housed within said spring cavity and is biased toward a compressed position.

18. A collapsible cleat apparatus as in claim 17 wherein said cleat body extends upward from said mount surface.

19. A collapsible cleat apparatus as in claim 17 wherein said cleat body is flush mounted to said mount surface and extends downward from said mount surface.

20. A collapsible cleat apparatus as in claim 19 further comprising a drain in said cleat well.

* * * * *